United States Patent [19]

Pelton

[11] 4,187,959

[45] Feb. 12, 1980

[54] PROPELLANTLESS AEROSOL DISPENSING SYSTEM

[75] Inventor: Peter G. Pelton, St. Louis, Mo.

[73] Assignee: The Continental Group, Inc., New York, N.Y.

[21] Appl. No.: 934,568

[22] Filed: Aug. 17, 1978

[51] Int. Cl.[2] ..... B67D 5/40

[52] U.S. Cl. ..... 222/94; 222/105; 222/333; 222/382; 222/383; 222/324

[58] Field of Search ..... 222/333, 383, 381, 382, 222/105, 94, 384, 385, 130, 131, 323, 324; 239/332; 310/103

[56] References Cited

U.S. PATENT DOCUMENTS

| | | | |
|---|---|---|---|
| 2,413,710 | 1/1947 | Jason | 222/383 X |
| 3,342,377 | 9/1967 | Peredy | 222/94 |
| 3,730,488 | 5/1973 | Gardner | 310/103 X |
| 3,825,156 | 7/1974 | Nobuo | 222/333 X |
| 3,871,555 | 3/1975 | Collins | 222/131 |
| 3,993,250 | 11/1976 | Shure | 222/383 X |
| 4,113,147 | 9/1978 | Frazier | 222/131 |
| 4,116,366 | 9/1978 | Takenakashima | 222/131 |

*Primary Examiner*—Allen N. Knowles
*Attorney, Agent, or Firm*—Charles E. Brown

[57] ABSTRACT

A dispensing container assembly which includes an outer support container of conventional construction having therein a product bag which is closed by a dispensing unit including a pump unit. A handle assembly is provided for interlocking supporting engagement with the dispensing unit and includes a drive motor for driving the pump unit. The handle assembly carries an electrical power supply which is automatically rechargeable when the handle assembly, attached to a container assembly, is seated on a supporting base.

12 Claims, 2 Drawing Figures

FIG. 1
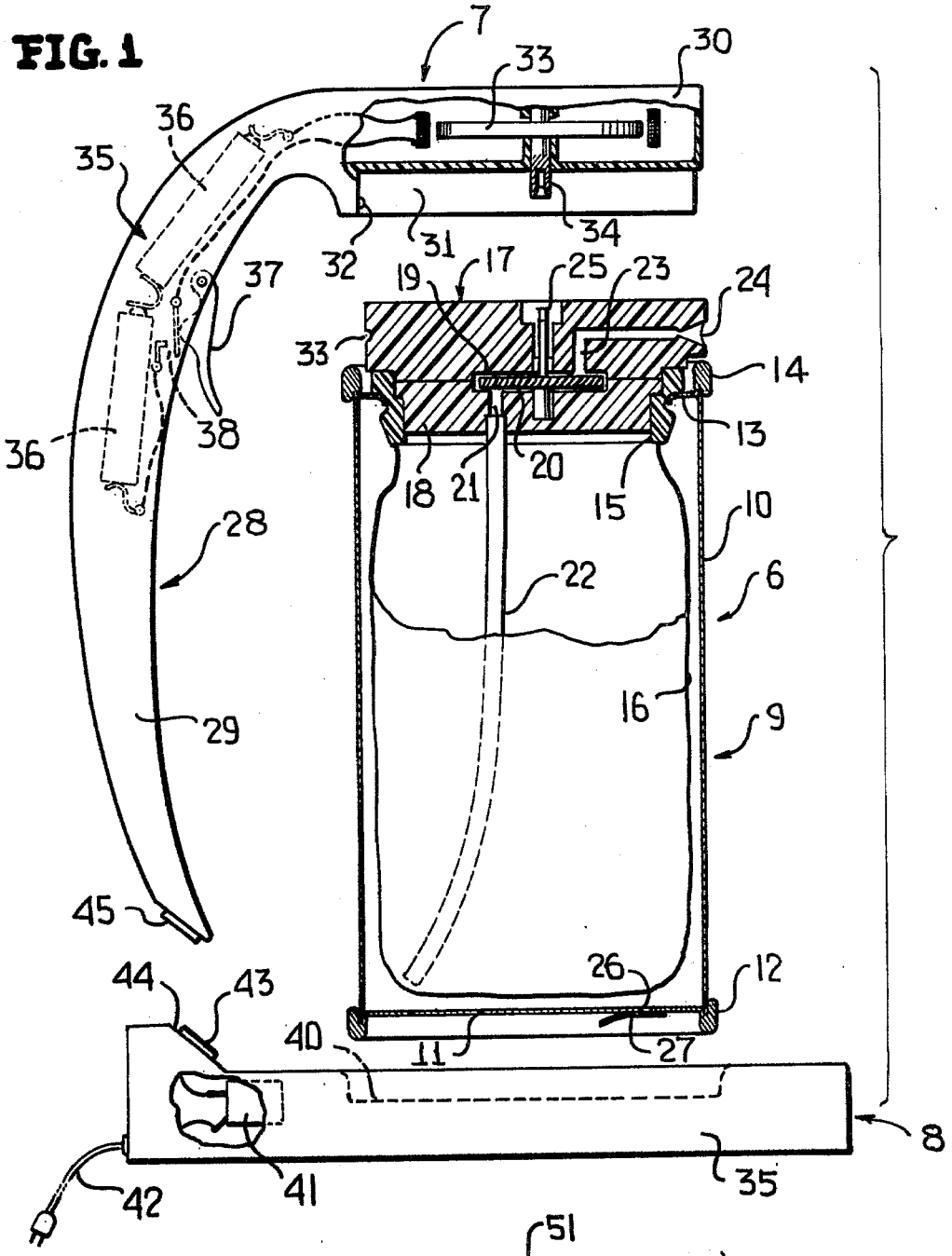
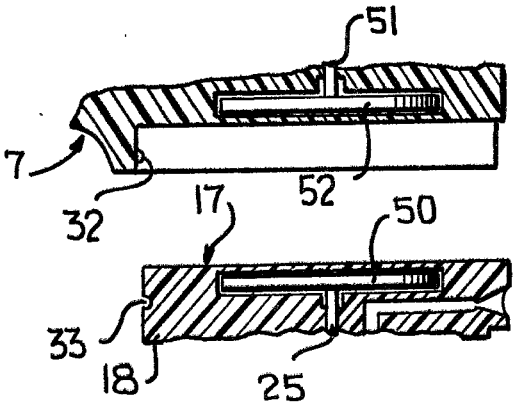
FIG. 2

PROPELLANTLESS AEROSOL DISPENSING SYSTEM

This invention relates to new and useful improvements in containers having a built-in dispensing system, and more particularly to a replacement for presently objectionable aerosol containers.

Known aerosol containers have become objectionable because the propellants utilized in connection therewith one either inherently dangerous when heated or are injurious to the atmosphere. The use of compressed air as a propellant is not satisfactory with respect to many products, and therefore is not a feasible substitute for known propellants.

In accordance with this invention, it is proposed to provide an economically feasible container having a product dispensing system which utilizes no propellants and wherein the contained products would be totally usable.

It is well known to utilize hand operated mechanical dispensers, but these dispensers are not fully satisfactory both from a convenience standpoint and the fact that the energy level during operation is not constant and does not provide for the necessary mechanical break-up action in the product being dispensed to produce the desired spray effect.

Power dispensers are well known. However, these units are very expensive and require that a special reservoir be directly filled with the product and thus are not readily adaptable to the economical packaging of products on a large commercial scale.

In accordance with this invention, it is proposed to provide a dispensing assembly which includes a support container which, for practical purposes as well as economy, may be in the form of a conventional can having at the upper end thereof a special end unit. This end unit includes an annular portion which is secured to the can by means of a conventional seam. The annular end unit carries a ring which, in turn, has bonded thereto a product container in the form of a flexible bag which may be readily collapsed. Finally, there is fixedly mounted within the ring a dispensing unit which includes a pump and wherein there is associated with the pump a mechanical product break-up nozzle which is particularly tailored to meet the requirements of the product to be dispensed as a spray.

In accordance with this invention, the dispensing unit is to be formed as inexpensively as possible and is not provided with motor means. A separate handle, which is interchangeable with numerous like containers having therein different products, is provided. The handle is releasably securable to the dispensing unit for supporting the dispensing assembly and has a motor which is suitably connected to the pump to effect operation thereof.

The handle may be provided with its own power supply in the form of rechargeable batteries, and there may also be provided a mounting base on which the support container may be seated in an at rest position and wherein the handle is automatically electrically connected to a recharging circuit for the purpose of recharging the power supply mounted thereby.

The dispensing assembly is particularly adapted for the spray dispensing of products such as hair spray, antiperspirant, paint, insecticide and the like. The support container may be of any desired configuration, shape, size or material in that it does not have a pressure resistance requirement.

With the above and other objects in view that will hereinafter appear, the nature of the invention will be more clearly understood by reference to the following detailed description, the appended claims, and the several views illustrated in the accompanying drawings.

IN THE DRAWINGS

FIG. 1 is an exploded schematic view with parts in section, showing the components of the dispensing assembly of this invention.

FIG. 2 is a fragmentary sectional view of the details of a modified form of drive.

Referring now to the drawings in detail, it will be seen that there is illustrated a propellantless aerosol dispensing assembly formed in accordance with this invention. The dispensing assembly is primarily formed by a container assembly 6 and further includes a handle unit 7 and preferably a mounting base 8.

The container assembly includes a support container, generally identified by the numeral 9, which may be of any conventional construction. For simplicity purposes, the support container 9 has been illustrated as being in the form of a conventional three-piece metal can which is known to be economical to manufacture. The support container 9 includes a conventional body 10 having the lower end thereof closed by an end unit 11 secured thereto by a conventional seam 12. The top end of the body 10 is closed by a multi-component assembly including an annular closure element 13 secured to the body 10 by a conventional seam 14. The annular closure element 13 carries a ring 15 which may be formed of any suitable material, but is preferably formed of a plastics material which is configurated for interlocking sealed engagement with the annular closure element 13. The ring 15 has bonded thereto in sealed engagement a product bag 16 which is preferably formed of a suitable plastics material and is of such wall thinness as to be readily collapsible. It is to be understood that the plastics material of the bag 16 is to be compatible with the product to be stored therein.

Finally, the top closure assembly includes a dispensing unit generally identified by the numeral 17. The dispensing unit 17 includes a suitable housing 18 which is preferably formed by molding or the like processing of plastics material. The interior of the housing 18 is configurated to define a pump chamber 19 in which a pump unit 20 of any desired type may be readily mounted. The pump unit 20, while illustrated as being of the gear type, could be of any other suitable type which can be driven by a rotary shaft.

The pump chamber 19 has communicated therewith an intake opening 21 to which there is coupled an inlet tube 22 for extension down into the bag 16. There is also in communication with the pump chamber 19 a discharge passage 23 which has incorporated therein a mechanical break-up nozzle 24. It is to be understood that the capacity of the pump unit 20 and the configuration of the nozzle 24 may be varied so as to provide the desired spraying of the particular product carried by the bag 10.

The pump unit 20, in the illustrated embodiment of FIG. 1, has a driven shaft 25 which is exposed at the upper surface of the housing 18.

At this time it is pointed out that initially the bag 16 substantially fills the support container 9 but collapses as the product is dispensed therefrom. Accordingly, it may be necessary to vent the interior of the support container 9, and to this end the end unit 11 may be provided with a vent opening 26. Further, if desired, prior to the initial use of the dispensing assembly, the vent 26 may be closed by a removable tear tape 27.

It is to be understood that the housing 18 is configurated so as to seat in the ring 15 and may be sealed relative to the ring in any desired manner so as to prevent both loss of the product to be dispensed and the contamination thereof.

It is to be understood that when the pump unit 20 is driven at a constant rate, a desired dispensing of the product as a spray will be effected, and this dispensing will be constant throughout the dispensing of the entire product supply. Although the bag will progressively collapse, it is to be understood that the product will continue to drain to the bottom of the bag and will be picked up by the tube or hose 22 so that substantially all of the product stored within the bag 16 can be dispensed, thereby providing for maximum usage of the product.

In order to effect both ease of handling of the container assembly 6 and the driving of the pump unit 20, there is provided the handle 7. The handle 7 may be of any desired configuration and includes generally a housing 28. The handle includes a grip portion 29 and a mounting portion 30. The underside of the mounting portion 30 is configurated as at 31 to receive the housing 18 and is provided with one or more projections 32 for engagement in an annular groove 33 formed in the outer surface of the housing 18. Thereby, an interlock between the handle assembly 7 and the dispensing unit 17 may be obtained.

The handle assembly includes an electric motor 33 of any suitable type which in the preferred embodiment of FIG. 1 includes a drive shaft 34 which projects for interlocking engagement with the driven shaft automatically upon interlocking of the handle assembly 7 with the housing 18.

In the embodiment of the handle assembly 7 illustrated in FIG. 1, there is provided a power supply 35 in the form of rechargeable batteries 36 which are electrically coupled to drive the motor 33 under the control of a trigger 37 actuated switch 38.

It is to be understood that the handle assembly 7 is to be universal as is the external configuration of the housing 18 so that various containers may be readily engaged by the handle and the pump unit thereof driven by the electric motor mounted within the handle.

It is also to be understood that the handle assembly 7 may be particularly configurated for use with a support container 9 of a preselected height. A mounting base 39, which is part of the mounting base assembly 8, may have an upper support well 40 for receiving the end unit 11 accurately to position the container assembly 6 on the base 39.

The base assembly 8 may include a charger 41 having a power supply 42 which may be coupled into an existing electrical outlet within a home. The charger 41 may be connected to suitable contacts 43 carried by a sloping portion 44 of the base 39. Like contacts 45 may be mounted on the housing 39 and electrically connected to the batteries 36 for effecting a recharging of the batteries utilizing the charger 41. It is to be understood that when the handle assembly 7 is interlocked with the housing 18 of the dispensing unit 17 and the container assembly 6 is seated on the charging base assembly 8, when the handle assembly 7 is properly oriented, electrical contacts 45 on the bottom of the handle will automatically engage corresponding electrical contacts 43 on the base 39. The contacts 45 may be suitably coupled to the batteries 36 for directing a charging electrical energy to the batteries.

It is to be understood that the coupling between the motor 33 and the pump unit 20 may be varied. For example, as shown in FIG. 2, the driven shaft 25 of the pump unit 20 may be provided with a magnetic coupling element 50. In a like manner, a drive shaft 51 of the electric motor 33 may be provided with a second magnetic coupling element 52 which is cooperable with the coupling element 50 so as magnetically to couple the driven shaft 25 to the motor drive shaft 51 when the housing assembly 7 is interlocked with the housing 18 of the dispensing unit 17.

It is to be understood that all of the components of the container assembly 6 including the dispensing unit 17 may be manufactured and assembled at a cost no greater than and generally less than the cost of prior aerosol containers, and therefore from the standpoint of packaging cost only, the container assembly 6 is economically feasible. Further, in view of the ability to dispense a larger percentage of the packaged product, the dispensing assembly 5 is economically feasible even when taking into consideration the added necessary cost of the handle assembly 7, and in certain instances the base assembly 8.

It will be readily apparent that the product stored within the bag 16 is in no way subject to contamination either by a gas, including air, or by any other foreign matter. Further, because the pump unit 20 will be driven at a constant rate, there will be a constancy in the supplying of the product with the product being directed from the dispensing unit 17 in a predetermined spray.

Although only two preferred embodiments of the dispensing assembly have been specifically illustrated and described herein, it is to be understood that minor variations may be made in the dispensing assembly without departing from the spirit and scope of the invention as defined by the appended claims.

I claim:

1. A propellantless aerosol dispensing assembly comprising a support container including a body and a bottom end, a partial top end in the form of an annular closure element, a product container carried by said annular closure element and disposed within said support container, a dispensing unit closing said support container and said product container, and single sealing means sealing said product container to both said dispensing unit and said closure element, said product container being in the form of a collapsible bag.

2. The dispensing assembly of claim 1 wherein said single sealing means is in the form of a single separately formed ring having separate surfaces for engaging said dispensing unit and said closure element.

3. The dispensing assembly of claim 2 wherein said bag is directly carried by said ring.

4. The dispensing assembly of claim 2 wherein said bag is directly carried by said ring, and said ring is directly interposed between said annular closure element and said dispensing unit.

5. A propellantless aerosol dispensing assembly comprising a support container including a body and a bottom end, a partial top end in the form of an annular closure element, a product container carried by said annular closure element and disposed within said support container, a dispensing unit closing said support container and said product container, and single sealing means sealing said product container to both said dispensing unit and said closure element, said dispensing unit being in the form of a closure element for said product container and having therein a pump unit, an intake for said pump unit opening into said product container, and a dispensing nozzle coupled to said pump unit for dispensing a product under controlled conditions, said pump unit including drive means for coupling said pump unit to a remote motor formed separate and apart from said dispensing unit.

6. The dispensing assembly of claim 5 wherein said drive means includes a drive shaft projecting from said dispensing unit.

7. The dispensing assembly of claim 5 wherein said drive means includes a magnetic coupling driven element for connection to a magnetic coupling driving element.

8. The dispensing assembly of claim 5 together with separately formed readily detachable handle means for said support container, and motor means carried by said handle means separate and apart from said dispensing unit and cooperable with said drive means.

9. The dispensing assembly of claim 8 wherein said handle means includes means for releasable snap interlocking engagement with said closure element.

10. The dispensing assembly of claim 9 wherein said handle means carries a self-contained power unit for said motor means.

11. The dispensing assembly of claim 8 wherein said handle means carries a self-contained power unit for said motor means.

12. A propellantless aerosol dispensing assembly comprising a support container including a body and a bottom end, a partial top end in the form of an annular closure element, a product container carried by said annular closure element and disposed within said support container, a dispensing unit closing said support container and said product container, and sealing means sealing said product container to said dispensing unit and said support container, said dispensing unit being in the form of a closure element having therein a pump unit, an intake for said pump unit, and a dispensing nozzle coupled to said pump unit for dispensing a product under controlled conditions, said pump unit including drive means for coupling said pump unit to a remote motor, handle means for said support container, motor means carried by said handle means and cooperable with said drive means, said handle means carrying a self-contained power unit for said motor means, and a support for said support container, said support and said handle means having cooperating means for recharging said power unit.

* * * * *